United States Patent [19]

Makino

[11] 4,403,704

[45] Sep. 13, 1983

[54] VERTICALLY PIVOTABLE BOOM BENDING DEVICE FOR CRANE

[75] Inventor: Kazuhiro Makino, Kudamatsu, Japan

[73] Assignee: Hitachi, Ltd., Tokyo, Japan

[21] Appl. No.: 364,470

[22] Filed: Apr. 1, 1982

[30] Foreign Application Priority Data

Apr. 8, 1981 [JP] Japan ..... 56-51781

[51] Int. Cl.[3] ..... B66C 23/82

[52] U.S. Cl. ..... 212/262; 212/187

[58] Field of Search ..... 212/186–188, 212/205, 211, 218, 237, 255, 257, 260, 262, 266; 414/917

[56] References Cited

U.S. PATENT DOCUMENTS

| | | | |
|---|---|---|---|
| 2,366,574 | 1/1945 | Taylor | 212/262 |
| 3,325,018 | 6/1967 | Wright | 212/187 |
| 3,722,705 | 3/1973 | Gould | 212/187 |

FOREIGN PATENT DOCUMENTS

| | | | |
|---|---|---|---|
| 2244585 | 3/1973 | Fed. Rep. of Germany | 212/262 |

*Primary Examiner*—Trygve M. Blix
*Assistant Examiner*—R. Johnson
*Attorney, Agent, or Firm*—Antonelli, Terry & Wands

[57] ABSTRACT

A vertically pivotable boom bending device for a crane including a main boom, a vertically pivotable boom including an inner boom section connected to the main boom for vertical pivotal movement and an outer boom section connected to the inner boom section for vertical pivotal movement, an articulating rope extending from a main body of the crane to the inner boom section, a rope winding device for paying out and gathering in the articulating rope and first tension means connecting the main body to the outer boom section. The device includes second tension means connected at one end to the main body and at the other end to the outer boom section for pivotal movement in a vertical plane. A point of connection of the inner boom section to the main boom, a point of connection of the inner boom section to the outer boom section, a point of connection of the second tension means to the main body and a point of connection of the second tension means to the outer boom section are arranged such that imaginary lines connecting these points of connection together substantially form a parallelogram. With the link motion including the four points of connection arranged to form a parallelogram, the vertically pivotable boom can be raised or lowered by the articulating rope by bending same at the junction of the inner boom section and the outer boom section and keeping the outer boom section substantially horizontal at all times.

4 Claims, 10 Drawing Figures

VERTICALLY PIVOTABLE BOOM BENDING DEVICE FOR CRANE

FIELD OF THE INVENTION

This invention relates to an articulating crane comprising a main boom and a vertically pivotable boom including an inner boom section and an outer boom section and connected to the outer end of the main boom for vertical pivotable movement, and more particularly it is concerned with a vertically pivotable boom bending device for such articulating crane capable of bending the vertically pivotable boom at the junction of the inner and outer boom sections during pivotal movement of the vertically pivotable boom.

DESCRIPTION OF THE PRIOR ART

Figure 1:
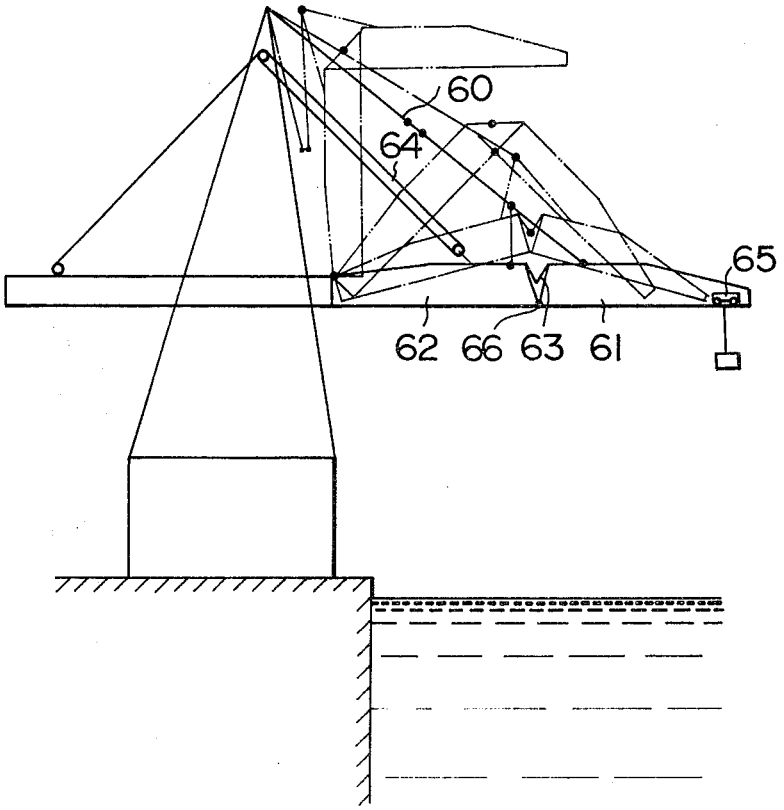
FIG. 1 PRIOR ART
FIG. 1 is a view showing in skeleton drawing an articulating crane of the prior art, showing the manner in which the vertically pivotable boom is bent at the junction of the inner boom section and the outer boom section in a multiplicity of stages of operation from the initial stage to the terminating stage.

A crane comprising a boom extending from the main body across a docked cargo ship functions to move a trolley back and forth on the boom between the shore of the harbor and the cargo ship, to carry the cargo to and from the ship by hanging same from the trolley.

In this type of crane, in order to avoid the boom hitting the mast or other superstructure of the cargo ship, the boom is pivotably moved in a vertical plane about the junction between the boom and the crane body to allow the ship to safely arrive at or depart from the dock.

However, when the boom has an inordinately great length, it would attain an abnormally high elevation and would be dangerous when pivotally moved in a vertical plane to an upstanding position. Moreover, such crane might interfere with the flight of aircraft.

To obviate these disadvantages, proposals have hitherto been made to bend the boom midway between the opposite ends when it is pivotally moved in a vertical plane so as to reduce its elevation when brought to an upstanding position.

In one device of the prior art for bending the vertically pivotable boom, the boom includes an inner boom section and an outer boom section connected together for pivotal movement about an axis of rotation, the inner boom section being connected to one rope for raising same and the outer boom section being connected to another rope for suspending same.

In the aforesaid device of the prior art, each rope has its own sheaving system for gathering in and paying out the rope to perform an operation of bringing the inner boom section and the outer boom section to a horizontal position in which they are in alignment with each other, and an operation of bending the inner boom section and the outer boom section at their junction to cause them to be angled relative to each other in a vertical plane. Thus the device of the prior art has had the trouble of having to manipulate the ropes individually to operate the respective boom sections.

Proposals have hitherto been made to eliminate this trouble. One such proposal is shown in Japanese Patent Application Laid-Open No. 130478/80, in which an outer boom section 61 and an inner boom section 62 connected together by a link 63 adapted to bend in the form of a letter V are supported by a special tension bar 60 to keep the two boom sections 61 and 62 from sagging in their initial horizontal position at initial stages of boom bending operation. In this construction, mainpulation of a rope 64 to raise the inner boom section 62 causes the inner boom section 62 and the outer boom section 61 to bend at their junction until the V-shaped link 63 is brought to a position in which it becomes straight, to thereby raise the inner boom section 62 to an upward projecting position while the outer boom section 61 is bent or angled with respect to the inner boom section. At the end of the operation, the outer boom section 61 is automatically brought to a forward projecting position in a horizontal plane, thereby enabling rope manipulation for the outer boom section 61 to be dispensed with. In the device of the prior art described hereinabove, the V-shaped link 63 begins to stretch itself immediately after the rope 64 is manipulated to raise the inner boom section 62 and the outer boom section 61 is angled with respect to the inner boom section 62 in the form of an inverted letter V during the operation, so that the two boom sections are greatly inclined relative to each other. Because of this angling of the two boom sections 61 and 62, equipment supported on the outer boom section 61 might have trouble, and, since the forward end of the outer boom section 61 drops to a low elevation during operation, the elevation achieved by the outer boom section 61 during the inner boom section raising operation is relatively low as compared with the angle at which the inner boom section 61 is raised. Thus the ship would have difficulty in leaving or arriving at the dock or moving beneath the boom unless the inner boom section 62 is raised to its final upward projecting position. A trolley 65 is positioned at the forward end of the outer boom section 61 when the inner boom section 62 and the outer boom section 61 are both disposed horizontally, and a downwardly directed force of great magnitude is exerted on the forward end of the outer boom section 61 when weighty cargo is suspended from the trolley 65. As a result, the boom sections 61 and 62 tend to behave in such a manner that they are bent in the form of an inverted letter V because a joint 66 between the two boom sections 61 and 62 is lifted, thereby rendering the structure unstable.

Figure 2:
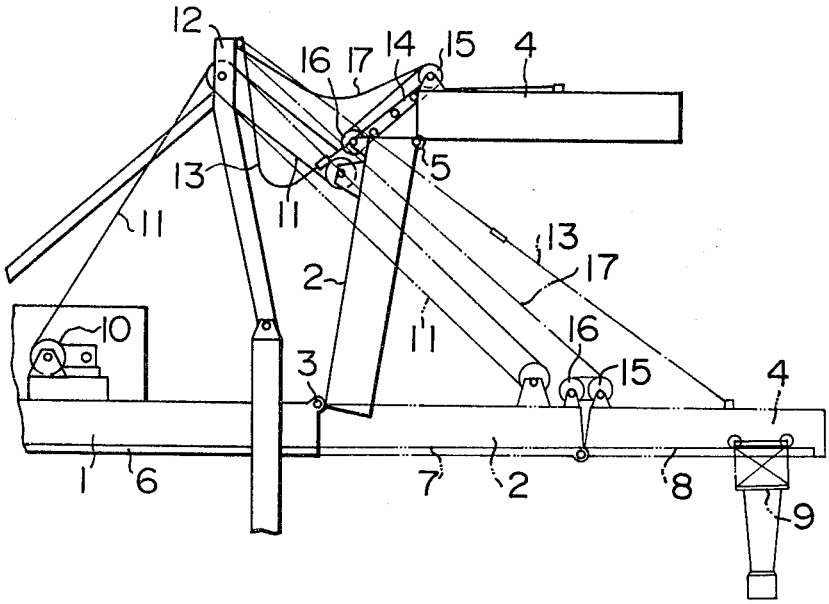
FIG. 2 PRIOR ART
FIG. 2 is a front view of the articulating crane of the prior art, showing the vertically pivotable boom being bent at the terminating stage of its operation at which the boom attains a maximum elevation.
Figure 3:
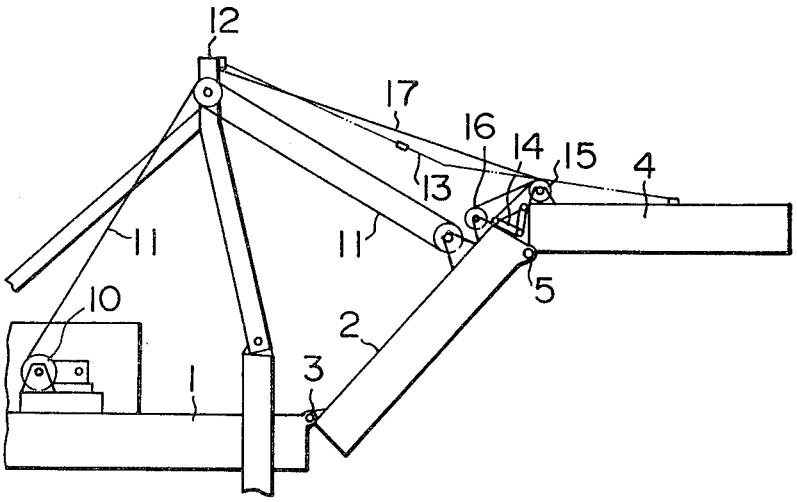
FIG. 3 PRIOR ART
FIG. 3 is a front view of the articulating crane of the prior art, showing the vertically pivotable boom shown in FIG. 2 being bent at an intermediate elevation.

FIGS. 2 and 3 show another example of a crane of the prior art in which the outer boom section is kept in a forward projecting position from start to finish during operation of the articulating crane actuated to raise the inner boom section to a vertically projecting position. The crane shown in FIGS. 2 and 3 is disclosed in U.S. Pat. No. 3,325,018 in which a main boom 1 of the bridge type crane has an inner boom section 2 pivotally connected to its outer end through a hinge 3 having a horizontal axis of rotation, and the inner boom section 2 has an outer boom section 4 pivotally connected to its outer end through a hinge 5 having a horizontal axis of rotation. The inner boom section 2 and outer boom section 4 constitute a vertically pivotable boom. The numerals 6, 7 and 8 designate rails secured to the main boom 1, rails secured to the inner boom section 2 and rails secured to the outer boom section 4 respectively. The rails 6, 7 and 8 are aligned with one another and interconnected when the vertically pivotable boom is disposed in a horizontal position to allow a trolley 9 to rollingly move therealong horizontally to perform loading and unloading of the docked ship. The inner boom section 2 is supported by a pivotally moving rope 11 operated by a rope winding system 10, and the outer boom section 4 is support by a rope 13 trained over an upper portion of a mast 12 of the crane and the outer boom section 4. A link means 14 comprising two rods pivotally connected to each other at one end thereof connects the inner boom section 2 and the outer boom section 4 together, and an articulating rope 17 trained over rope shieves 15 and 16 attached to the segments 2 and 4 respectively further connects the inner boom segment 2 and the outer boom segment 4 together. The articulating rope 17 is further trained over the top of a mast 12.

In the bridge type crane of the aforesaid construction, the inner boom section 2 is moved upwardly in pivotal movement as shown in FIG. 3 as the pivotally moving rope 11 is gathered in by the rope winding system 10. Upward pivotal movement of the inner boom section 2 loosens the rope 13 and moves the articulating rope 17 to a position between the rope shieves 15 and 16, so that the outer boom section 4 begins to pivotally move about the hinge 5 with respect to the inner boom section 2 as shown in FIG. 2. As the outer boom section 4 begins to move pivotally, the linkage 14 begins to be elongated. Further gathering of the pivotally moving rope 11 causes the articulating rope 17 to loosen as shown in a solid line in FIG. 2, to bring the linkage 14 to a straight line position. As a result, the inner boom section is brought to an upward projecting position and the outer boom section 4 is brought to a forward projecting position. In this condition, the cargo ship can move beneath the outer boom section 4 without any trouble and the elevation of the vertically pivotable boom reached in the upstanding position can be reduced.

In the bridge type crane of the aforesaid construction in which the vertically pivotable boom is bent at its intermediate point, bending is carried out as follows. The final bending angle is decided by the linkage 14 mounted between the inner boom section 2 and the outer boom section 4 for pivotal movement until the outer boom section 4 is brought to a horizontal position, and the intermediate bending angle is maintained in a manner to keep the outer boom section 4 substantially horizontal by the movement of the articulating rope 17 trained over the inner boom section 2 and outer boom section 4 to a position between the rope shieves 15 and 16.

The vertically pivotable boom can be brought to a horizontal position as indicated by dash-and-dot lines in FIG. 2 by paying out the pivotally moving rope 11 from the rope winding system 10. The ropes 13 and 17 finally become taut and the linkage 14 is bent. Thus the inner boom section 2 and the outer boom section 4 can be held horizontal by the ropes 13 and 17 to allow the trolley 9 to travel on the raisl 6–8 along the booms 1, 2 and 4 to load or unload the cargo ship.

One of the disadvantages of the bridge type crane provided with a vertically pivotable boom that is bent at its midpoint is that its construction is complex and requires a large number of parts including the articulating rope 17, rope shieves 15 and 16 and linkage 14. Also, when the vertically pivotable boom is brought to an upright position, the articulating rope 17 becomes loose as indicated by solid lines in FIG. 3 at final stages of the operation and are liable to be off the rope shieves 15 and 16, which is dangerous. The ropes 13 and 17 keeping the outer boom section 4 horizontal when the vertically pivotable boom is disposed in a horizntal position are liable to be stretched. If they are stretched by the weight of the trolley 9 and the cargo, the outer boom section 5 would pivot about the hinge 5 when the vertically pivotable boom is disposed horizontally, so that the trolley 9 would be prevented from moving between the rails 7 and 8. Thus it would become impossible to keep the outer boom section 4 in a predetermined attitude at all times.

Although the opposite ends of the inner boom section 2 and outer boom section 4 are connected together at the lower end by the hinge 5, no means is provided at the upper end to keep the spacing therebetween. Thus the portions of the ends of the boom sections 2 and 4 tend to move toward and away from each other, so that the attitudes of the boom sections 2 and 4 would become unstable and make it impossible to keep the outer boom section 4 at a predetermined attitute at all times.

OBJECT AND STATEMENT OF THE INVENTION

Accordingly a main object of the invention is to provide, in a crane in which a vertically pivotable boom comprising an inner boom section and an outer boom section is bent substantially at its midpoint, a vertically pivotable boom bending device of simple construction capable of keeping the outer boom section substantially horizontal during vertically pivotable boom bending operation.

A subsidiary object of the invention is to provide a vertically pivotable boom bending device which, while enabling the aforesaid main object to be accomplished, is able to obtain improved stability of the outer boom section disposed in a forward projecting position in which it extends forwardly in a horizontal plane.

A still another subsidiary object is to provide a vertically pivotable boom bending device which, while enabling the aforesaid main object to be accomplished, is capable of keeping a force of inordinately large magnitude from being exerted on the device.

According to the invention, there is provided, in a crane comprising a main boom, a vertically pivotable boom comprising an inner boom section connected to the outer end of the main boom for vertical pivotal movement and an outer boom section connected to the outer end of the inner boom section for vertical pivotal movement, an articulating rope extending from a main body of the crane to the inner boom section, a rope winding system for paying out and gathering in the articulating rope and first tension means connecting the main body of the crane to the outer boom section, a vertically pivotable boom bending device comprising second tension means connected at one end thereof to the main body of the crane for pivotal movement in a vertical plane and at the other end thereof to the outer boom section for pivotal movement in a vertical plane, wherein a point of connection of the inner boom section to the main boom of the crane, a point of connection of the inner boom section to the outer boom section, a point of connection of the second tension means to the main body of the crane and a point of connection of the second tension means to the outer boom section are located such that imaginary lines connecting these points of connection together form a pallalerogram.

DESCRIPTION OF THE PREFERRED EMBODIMENTS

Figure 4:
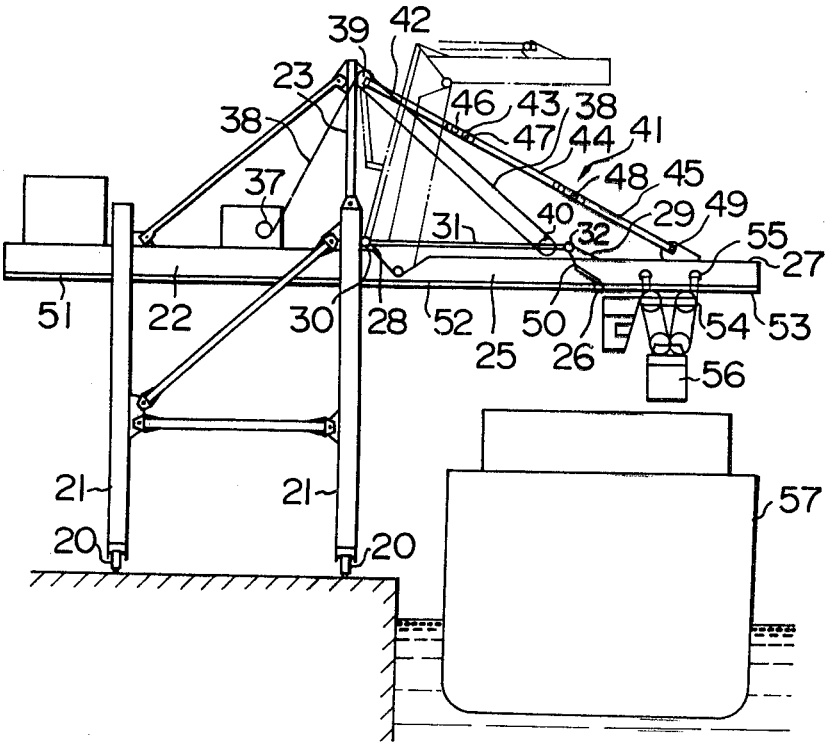
FIG. 4 is a front view of an articulating crane comprising one embodiment of the invention, showing the crane performing unloading of a ship.

FIG. 4 shows one embodiment of the invention. The bridge type crane shown in the figure includes a main body comprising vertical standing legs 21 supported at their lower ends by wheeled means 20, a main boom 22 supported in a horizontal position by the legs 21, and a mast 23 connected to the top of one of the legs 21.

Figure 5:
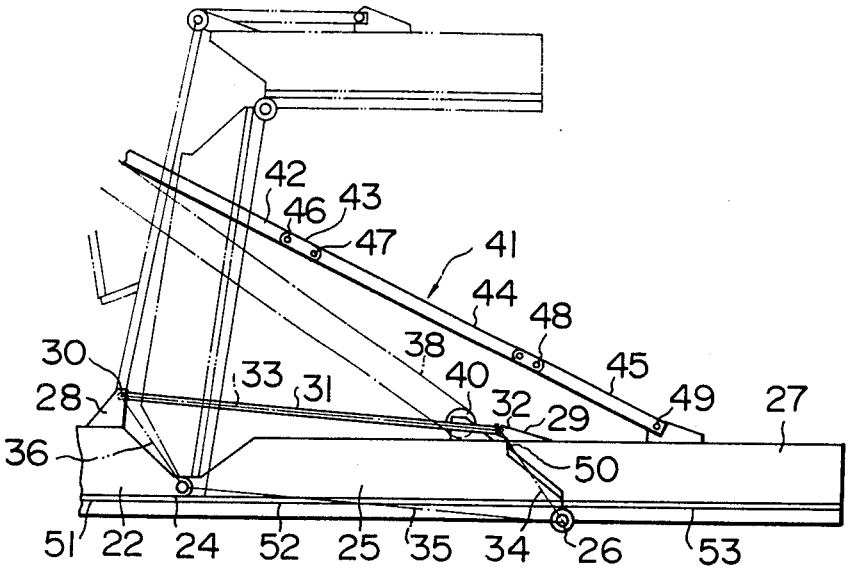
FIG. 5 is a front view of the articulating crane shown in FIG. 4, showing its vertically pivotable boom on an enlarged scale.

As shown in FIGS. 4 and 5, the main boom 22 has connected to its outer end through a hinge 24 for vertical pivotal movement an inner boom section 25 which in turn has connected to its outer end through a hinge 26 for vertical pivotal movement an outer boom section 27. The inner boom section 25 and outer boom section 27 constitute a vertically pivotable boom.

As shown in FIG. 4, an articulating rope 38 paid out and gathered in by a rope winding system 37 on the main boom 22 is trained over a rope shieve 39 on the mast 23 and a rope shieve 40 on the inner boom section 25. Meanwhile a tension bar 41 connects the outer boom section 27 to the top of the mast 23. The tension bar 41 is composed of four elongated steel rods 42, 43, 44, which do not substantially expand or contract, rotatably connected together through pins 46, 47 and 48 and connected at one end to the top of the mast 23 through a hinge for vertical pivotal movement and at the other end to the outer boom section 27 through a hinge 49 for vertical pivotal movement.

A connection point 50 between the inner boom section 25 and outer boom section 27 is located at a level higher than the hinge 26 in a position in which the boom sections 25 and 27 abut against each other when they extend horizontally. The main boom 22, inner boom section 25 and outer boom section 27 have rails 51, 52 and 53 secured thereto respectively, with the raisl 51, 52 and 53 being aligned with one another when the boom sections 25 and 27 are disposed horizontally. A trolley 54 shown in FIG. 4 has wheels 55 for travelling on the rails 51, 52 and 53 in alignment with one another in a horizontal plane to perform loading and unloading of a docked freighter 57 by carrying cargo 56.

The position in which the tension bar 41 is connected to the outer boom section 27 or the position of the hinge 49 is located sufficiently near the foremost end of the outer boom section 27 to allow compressive force to be applied to the connecting point 50 between the two boom sections 25 and 27 when the cargo 56 is suspended from the trolley 54.

As shown in FIG. 5, the main boom 22 has a bracket 28 secured thereto and the outer boom section 27 has another bracket 29 secured thereto.

The aforesaid construction is shared by all the embodiments of the invention.

In the first embodiment shown in FIGS. 4 and 5, a rod 31 is connected at one end through a hinge 30 to the bracket 28 for vertical pivotal movement and at the other end through a hinge 32 to the bracket 29 for vertical pivotal movement. In connecting the rod 31 to the brackets 28 and 29, the positions in which the hinges 30 and 32 are located and selected such that imaginary lines 33, 34, 35 and 36 connecting the hinges 24, 26, 30 and 32 together form a parallelogram.

In the first embodiment, as the rope winding system 37 is actuated to gather in the articulating rope 38, the inner boom section 25 is pivotally moved about the hinge 24 in a vertical plane. During vertical pivotal movement of the inner boom section 25, the vertically pivotable boom is raised while the imaginary lines 33, 34, 35 and 36 connecting the hinges 24, 26, 30 and 32 together remain in the form of a parallelogram. This allows the outer boom section 27 to move upwardly as indicated by dash-and-dot lines in FIGS. 4 and 5 while being maintained horizontal during operation.

Thus the vertically pivotable boom can have its maximum elevation greatly reduced as compared with that in the prior art, so that the safety of the boom can be ensured.

When the vertically pivotable boom is raised as aforesaid, the tension bar 41 is pivoted about the pins 46, 47 and 48 so as not to interfere with the raising of the vertically pivotable boom. Pivotal movement of the outer boom section 27 with respect to the inner boom section 25 applies tension to the rod 31. The tension acts on the boom sections 25 and 27 in such a manner that they are pulled away from the main boom 22, to thereby lessen the load applied to the articulating rope 38 for raising the vertically pivotable boom.

To bring the inner boom section 25 and outer boom section 27 to a horizontal position or to lower the vertically pivotable boom, the rope winding system 37 is actuated to pay out the articulating rope 38. This causes the inner boom section 25 to pivotally move downwardly about the hinge 24 in a vertical plane. During downward pivotal movement of the inner boom section 25, the imaginary lines 33, 34, 35 and 36 remain in the form of a palallelgram and allow the outer boom section 27 to remain horizontal while being lowered, until the boom sections 25 and 27 are brought into abutting engagement with each other at the connecting point 50 and the boom sections 25 and 27 are aligned with each other in a horizontal plane as shown in FIGS. 4 and 5. At this time, the tension bar 41 becomes straight and supports the outer boom section 27 in a manner to pull the outer boom section 27 toward the mast 23. This lessens the load applied to the rod 31 by the outer boom section 27. Thus the rod 31 need not have high strength. When the trolley 54 hangs the cargo 56 in any position on the boom sections 25 and 27 disposed horizontally, the inner boom section 25 and outer boom section 27 would tend to bend in the form of a letter V about the hinge 26 if the position of the trolley 54 were nearer to the main body of the crane than the hinge 49. However, this tendency can be avoided by the abutting engagement of the boom sections 25 and 27 with each other at the connecting point 50. When there is no connecting point 50, the rod 31 would bear the load to keep the two boom sections 25 and 27 from being bent apart. When the position of the trolley 54 is nearer to the foremost end of the outer boom section 27 than the hinge 49, the boom sections 25 and 27 would tend to bend in the form of an inverted letter V about the hinge 26. However, such tendency can be avoided by the rod 31 and tension bar 41 pulling the outer boom section 27 in reaction to the force tending to urge the boom sections 25 and 27 to bend apart, to allow the boom sections 25 and 27 to remain in a horizontal position. The rod 31 is advantageous as compared with a rope because of being less susceptible to elongation deformation, so that the outer boom section 27 can be held horizontal at all times.

Particularly, by setting the position of the hinge 49 or the connecting point between the tension bar 41 and outer boom section 27 sufficiently near the foremost end of the outer boom section 27 to have a compressive force or a biasing force exerted on the connecting point 50 between the boom segments 25 and 27, the boom sections 25 and 27 are kept in abutting relation to each other at the connecting point 50 even if the cargo 56 is hung from the trolley 54 and the rod 31 has play at its connecting points. Thus the operation can be performed safely because the outer boom section 27 can be kept in a horizontal position at all times.

In the event the connecting points of the rod 31 lack play that would be allowed in design, the compressive force exerted on the connecting point 50 between the boom segments 25 and 27 would be exerted on the rod 31 and might be difficultly transmitted to the connecting point 50.

Figure 6:
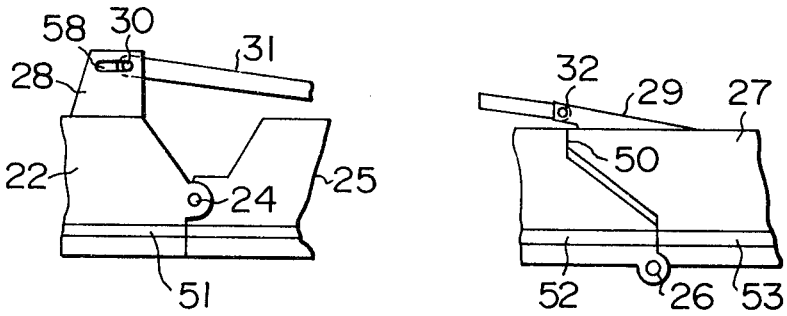
FIG. 6 is a fragmentary front view of an articulating crane comprising a second embodiment, showing the essential portions thereof.

To cope with such trouble, a second embodiment of the invention shown in FIG. 6 is provided. More specifically, the second embodiment shown in FIG. 6 involves a modification to the mounting of the rod 31 on the bracket 28 shown in FIGS. 4 and 5, and other parts are similar to those of the first embodiment. In FIG. 6, the bracket 28 secured to the main boom 22 is formed with a slot 58 having its major dimension extending horizontally for receiving the hinge 30 connected to the bar 31 for movement within the extent of the major dimension.

By this arrangement, the rod 31 is movable longitudinally thereof for the extent of the major dimension of the slot 58. Thus the compressive is kept from being transmitted to the rod 31 and concentrated on the connecting point 50, so that the outer boom section 27 can be kept horizontal and in alignment with the inner boom section 25.

By avoiding concentration of the compressive force on the rod 31 in this way, no force is unduly exerted on the rod 31 which is a member of the vertically pivotable boom bending device according to the invention, so that the device can operate safely.

Figure 10:
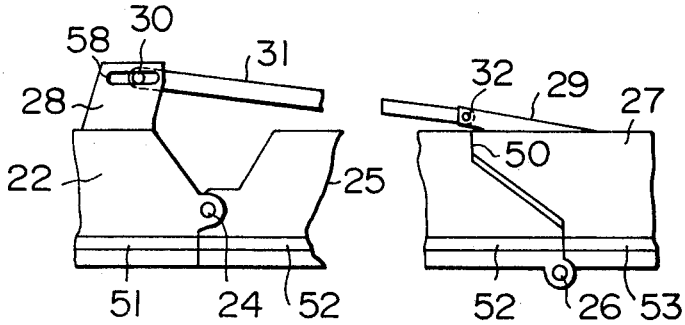
FIG. 10 is a front view of an articulating crane comprising a fourth embodiment, showing the essential portions thereof.

To avoid application of inordinately high tension to the rod 31, a fourth embodiment of the invention is provided as shown in FIG. 10 in which the slot 58 formed in the bracket 28 has its major dimension increased as compared with that of the second embodiment shown in FIG. 6. In this case, when the rod 31 is pulled toward the outer boom section 27, the hinge 30 moves in the slot 58 rightwardly in the figure to prevent inordinately high tension being applied to the rod 31, to allow the device to operate safely.

Figure 7:
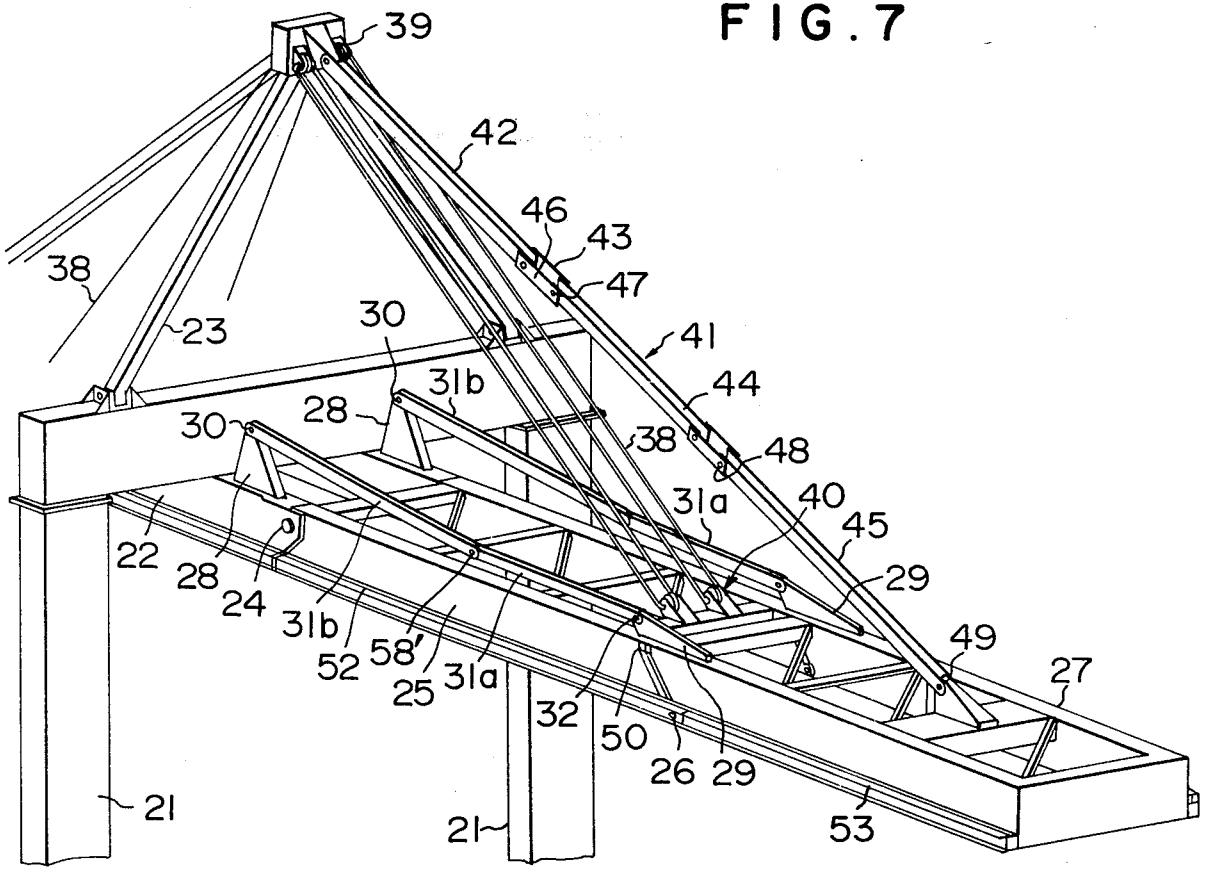
FIG. 7 is a perspective view of an articulating crane comprising a third embodiment, showing the essential portions thereof.
Figure 8:
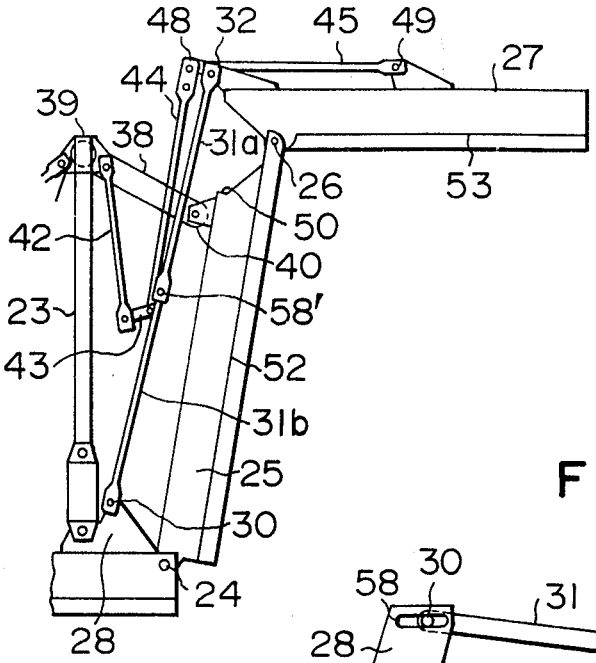
FIG. 8 is a front view of the articulating crane shown in FIG. 7, showing the vertically pivotable boom thereof being bent at a maximum elevation.
Figure 9:
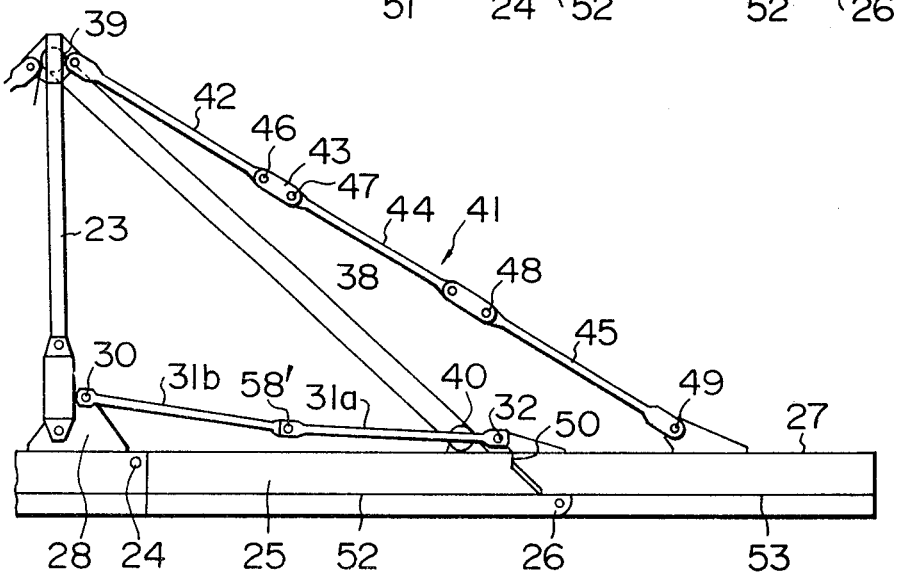
FIG. 9 is a side view of the vertically pivotable boom of the articulating crane shown in FIG. 7.

A third embodiment shown in FIGS. 7–9 is provided to keep an inordinately high force from being exerted on the rod means connecting the bracket 28 to the outer boom section 27 without relying on the slot 58. As shown in FIG. 7, a rod **31*b* connected to the bracket 28 through the hinge 30 at one end for vertical pivotal movement is connected at the other end to one end of a rod 31*a* for vertical pivotal movement about a pin 58', the rod 31*a* being connected at the other end through the hinge 32 to the outer boom section 27 for vertical pivotal movement. The distance between the hinges 32 and 30 is slightly smaller than the distance between the hinges 24 and 26, so that imaginary lines connecting the hinges 24, 26, 30 and 32 together are arranged to provide a form slightly deviating from a parallelogram. When the outer boom section 27 is horizontal and the inner boom section 25 is substantially parallel to the rods 31*a* and 31*b* as shown in FIG. 8, the rods 31*a* and 31*b* is slightly bent at the pin 58' in the form of a letter V. When the inner boom section 25 is moved pivotally upwardly about the hinge 24 by actuating the articulating rope 38, the rods 31*a* and 31*b* are aligned with each other and the distance between the hinges 30 and 32 is slightly increased, so that imaginary lines connecting the hinges 24, 26, 30 and 32 form a parallelogram. Thus the outer boom section 27 can be held in a horizontal position. In this embodiment, when a compressive or tensile force is exerted on the rods 31*a* and 31*b* when they are in positions shown in FIG. 8, the tendency of the rods 31*a* and 31*b* to be bent into the form of a letter V about the pin 58' is increased. Thus no unduly high force is exerted on the rods 31*a* and 31*b***.

In the third and fourth embodiments, the imaginary lines connecting the hinges 24, 26, 30 and 32 do not form a parallelogram in a strict sense of the term and are in a slight modified form of the parallelogram. However, a deviation from the parallelogram is very slight in degree and the outer boom section 27 can be kept substantially horizontal both when the vertically pivotable boom is raised and lowered by actuation of the articulating boom 38.

Particularly in the fourth embodiment, the rods **31*a* and 31*b* are kept from loosening and forming a letter V, so that the compressive force can be concentrated on the connecting point 50 between the two boom sections 25 and 27 to keep the boom sections 25 and 27** positively in contact with each other to keep them in alignment with each other.

In any and each of the embodiments, the outer boom section 27 can be supported in a horizontal position by the rod means 31 or **31*a* and 31*b* after the vertically pivotable boom is raised or lowered relative to the main boom 22. Thus no bending force is exerted on the inner boom section 25 and the outer boom section 27 can be held in a horizontal position without being wobbly. Also, in case a high downwardly-directed force is exerted on the forward end of the outer boom section 27 when the inner and outer boom sections 25 and 27 are in a horizontal position and form a straight line, the forward end of the outer boom section 27 would tend to rotate downwardly about the hinge 26. Such force could be offset by the rod means 31 or 31*a* and 31*b* to avoid pivotal movement of the outer boom section 27 away from the main body of the crane to thereby prevent great wobbling of the vertically pivotable boom. While the wobbling of the vertically pivotable boom can thus be avoided, no bending load is applied by the outer boom section 27 to the inner boom section 25, to thereby enable prevention of wobbling of the outer boom section 27** to be effected more positively.

In each and any of the embodiments, the invention enables the vertically pivotable boom to be raised or lowered while keeping the outer section 27 thereof in a horizontal position at all times by the simple construction of connecting the outer boom section 27 to the main body of the crane by the rod means 31 or 31*a* and 31*b*.

The rod means 31 or 31*a* and 31*b* has only to have strength with respect to a tension to perform necessary function. Thus rope means may be used in place of the rod means. When rope means is used, the rope has a characteristic such that it is loosened when a compressive force is exerted thereon. Thus no protection need be provided to the rope to guard against any compressive force that might be exerted thereon.

What is claimed is:

1. In a crane comprising a main boom, a vertically pivotable boom comprising an inner boom section connected to the outer end of the main boom for vertical pivotal movement and an outer boom section connected to the outer end of the inner boom section for vertical pivotal movement, an articulating rope extending from a main body of the crane to the inner boom section, a rope winding system for paying out and gathering in the articulating rope and first tension means connecting the main body of the crane to the outer boom section, a vertically pivotable boom bending device comprising:

second tension means connected at one end thereof to the main body of the crane for pivotal movement in a vertical plane and at the other end thereof to the outer boom section for pivotal movement in a vertical plane, wherein a point of connection of the inner boom section to the main boom of the crane, a point of connection of the inner boom section to the outer boom section, a point of connection of the second tension means to the main body of the crane and a point of connection of the second tension means to the outer boom section are located such that imaginary lines connecting these points of connection together form a substantial parallelogram.

2. A vertically pivotable boom bending device as claimed in claim 1, wherein portions of the inner boom section and the outer boom section brought into contact with each other when the inner boom section and the outer boom section are disposed in a horizontal position at the same level as the main boom of the crane are located at a higher level than the point of connection between the inner boom section and the outer boom section.

3. A vertically pivotable boom bending device as claimed in claim 1 or 2, wherein the point of connection of the second tension means to the main body of the crane or the outer boom section comprises a pin-and-slot arrangement in which a slot may be formed longitudinally in the second tension means and a pin may be connected to the main body of the crane or the outer boom section or vice versa, whereby the second tension means can be flexibly connected to the main body of the crane or the outer boom section by the pin-and-slot arrangement.

4. A vertically pivotable boom bending device as claimed in claim 1 or 2, wherein said second tension means comprises a plurality of rods connected together for pivotal movement relative to each other in a vertical plane, said rods constituting the second tension means being connected to each other in such a manner that when the inner boom section and the outer boom section are horizontal in a straight line, the second tension means extending between the main body of the crane and the outer boom section is slightly bent at the junction of the rods.

* * * * *